US007690939B2

(12) United States Patent
Wu

(10) Patent No.: US 7,690,939 B2
(45) Date of Patent: Apr. 6, 2010

(54) ELECTRONIC MODULE WITH EASILY OPERATED LATCH MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/154,379

(22) Filed: May 22, 2008

(65) Prior Publication Data

US 2009/0291578 A1 Nov. 26, 2009

(51) Int. Cl.
*H01R 13/627* (2006.01)

(52) U.S. Cl. ..... 439/352; 439/160

(58) Field of Classification Search ..... 439/76.1, 439/157, 160, 352; 385/92, 93, 94; 361/754, 361/728, 801
See application file for complete search history.

(56) References Cited

U.S. PATENT DOCUMENTS 6,731,510 B1 * 5/2004 Hwang et al. ..... 361/754
6,758,699 B1 * 7/2004 Hwang et al. ..... 439/676
6,786,653 B1 * 9/2004 Hwang et al. ..... 385/92
6,851,867 B2 2/2005 Pang et al.
7,147,502 B1 * 12/2006 Wu ..... 439/352
7,207,823 B1 * 4/2007 Yang ..... 439/352
7,238,040 B1 * 7/2007 Wu ..... 439/352
7,402,070 B1 * 7/2008 Wu ..... 439/352
2007/0117458 A1 5/2007 Winker et al.

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

An electronic module (100) includes an elongated housing (10) having a front portion and a rear portion, with a pair of spaced guide members (123) integrated with a peripheral portion of the rear portion; a latch mechanism (60) assembled to the housing, said latch mechanism including a slider member (61) disposed between and supported by the pair of guide members, a bail member (62) pivotally engaging with the rear portion of the housing and further linking with the slider member; and rocking the bail actuating the slider moving along a front-to-back direction for detaching the electronic module from a receptacle module.

6 Claims, 7 Drawing Sheets

ELECTRONIC MODULE WITH EASILY OPERATED LATCH MECHANISM

FIELD OF THE INVENTION

The present invention generally relates to an electronic module, and more particularly to an electronic module having an easily operated latch mechanism.

DESCRIPTION OF PRIOR ART

The small form-factor pluggable (SFP) is a compact optical transceiver used in optical communications for both telecommunication and data communications applications. It interfaces a network device mother board (for a switch, router or similar device) to a fiber optic or unshielded twisted pair networking cable. It is a popular industry format supported by several fiber optic component vendors. SFP transceivers are designed to support SONET, Gigabit Ethernet, Fibre Channel, and other communications standards. The standard is expanding to SFP+ which will be able to support data rates up to 10.0 Gbit/s.

Nowadays, there is a trend that an electronic device is configured to be lower profile, and so do the peripheral components equipped thereto, such as I/O ports, etc. As a SFP module (electronic module) becomes smaller, it is difficult for users to hold it, especially detach it from a cage of a receptacle module.

A simple release method for a SFP module is to hold the module itself and then pull them out of a receptacle module (cage assembly). However, It has been determined that this method is not very effective and reliable. When the SFP module mates with the receptacle module, only little rear portion thereof is exposed outside, thus it difficult to grip thereon; furthermore, users may hold a cable attached to the module and pull the module out of the receptacle module directly, and incorrect operation may damage the module.

Therefore, designers developed different solutions to solve above problems. U.S. Pat. No. 6,851,867 issued to Pang on Feb. 8, 2005 discloses an electronic module received in corresponding cage of a module receptacle and the electronic module comprises a pair of sliders with forward ends engaging with tabs of the cage, and a bail or lever capable of rotating to actuate the sliders linearly to separate forward ends of the sliders from the tabs. The Pang's device utilizes leverage to successfully solve the problem aforementioned. However, as the bail or lever is too small to grip by users, thus, it's necessary to provide an electronic module with easily operated latch mechanism.

U.S. Pat. No. 6,758,699 issued to Huang on Jul. 6, 2004 introduces another kind of electronic module which comprises a horizontal printed circuit board; a metallic cage enclosing said printed circuit board; a connector located in front of the printed circuit board and including an insulative housing enclosed in a metallic shell; a plurality of terminals located in the housing, and mechanically and electrically connected to the printed circuit board; and a clamp device being discrete from and located right behind the connector and in front of the printed circuit board, said clamp device attached to at least one of said shell and said housing, wherein said clamp device is equipped with a latch mechanism including an extraction tab moveable along a front-to-back direction and actuated to move by a pivotal actuator. The Huang's device is complicated and cost in manufacture. A more simplified and lower cost electronic module is desired.

SUMMARY OF THE INVENTION

Accordingly, an object of the present invention is to provide an electronic module with easily released latch mechanism.

In order to achieve the object set forth, an electronic module in accordance with the present invention comprises an elongated housing having a front portion and a rear portion, with a pair of spaced guide members integrated with a peripheral portion of the rear portion; a latch mechanism assembled to the housing, said latch mechanism including a slider member disposed between and supported by the pair of guide members, a bail member pivotally engaging with the rear portion of the housing and further linking with the slider member to move the slider member.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
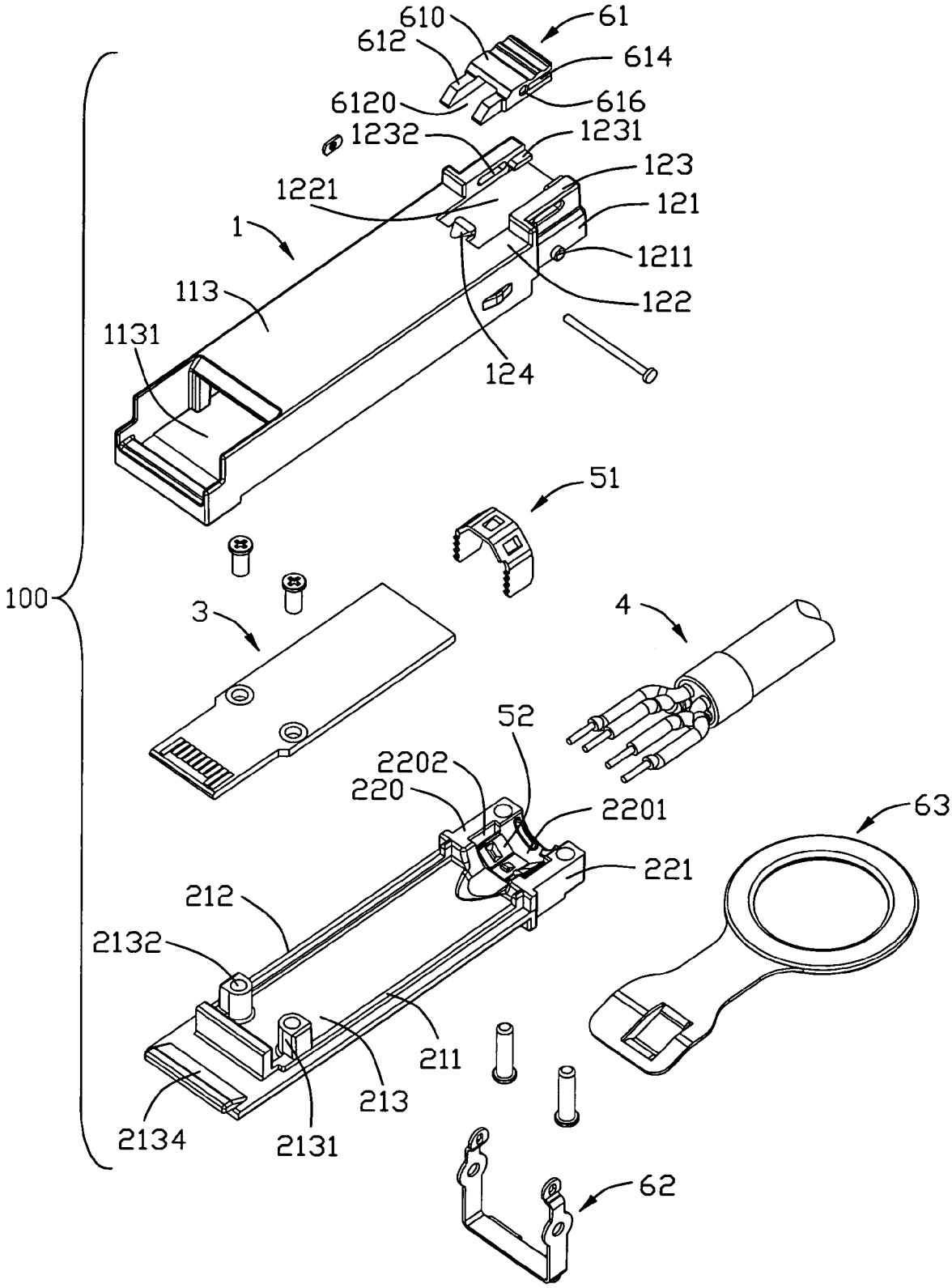
FIG. 1 is an exploded, perspective view of a cable connector in accordance with the present invention.
Figure 2:
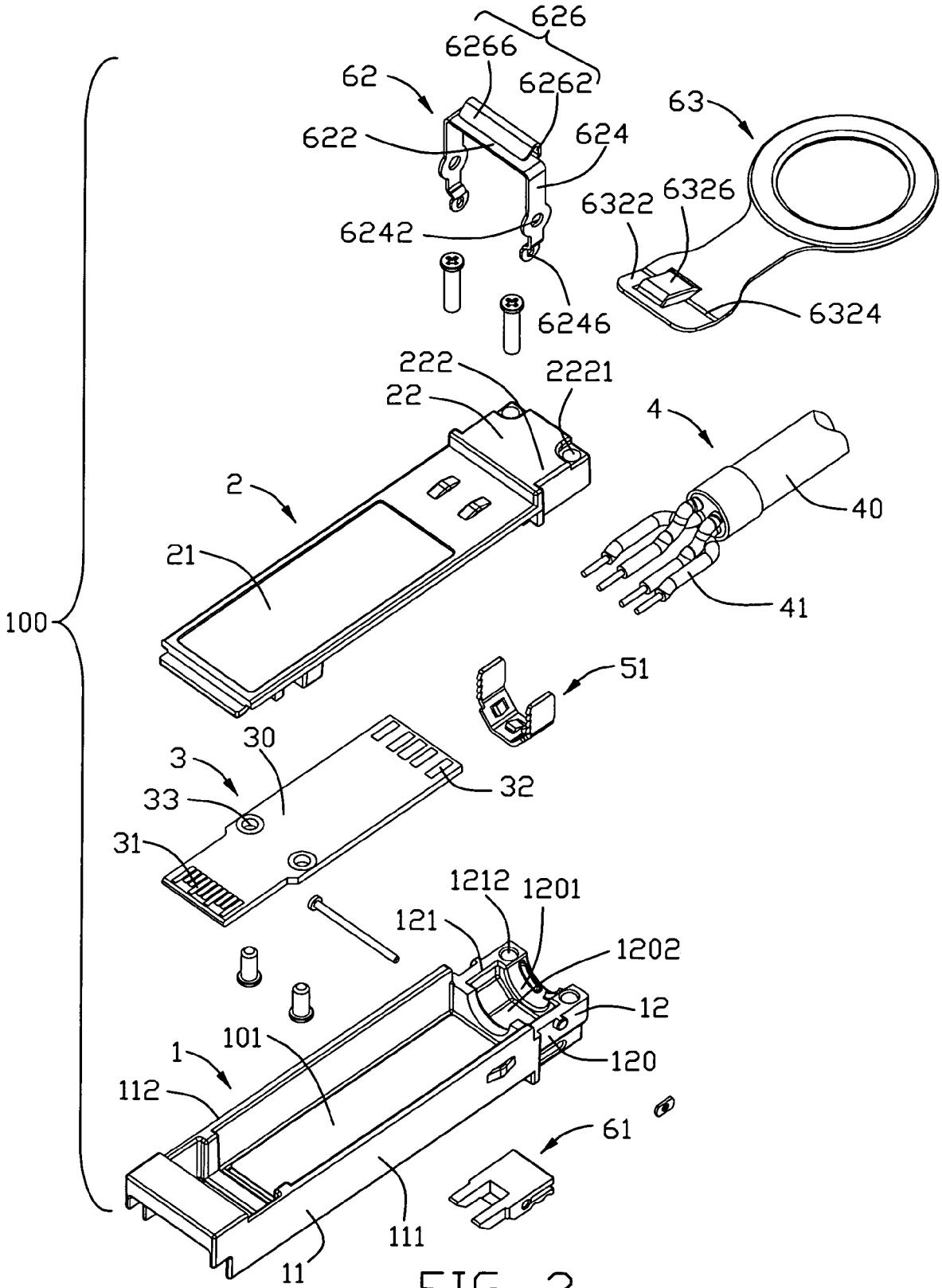
FIG. 2 is similar to FIG. 1, but viewed from another aspect.
Figure 3:
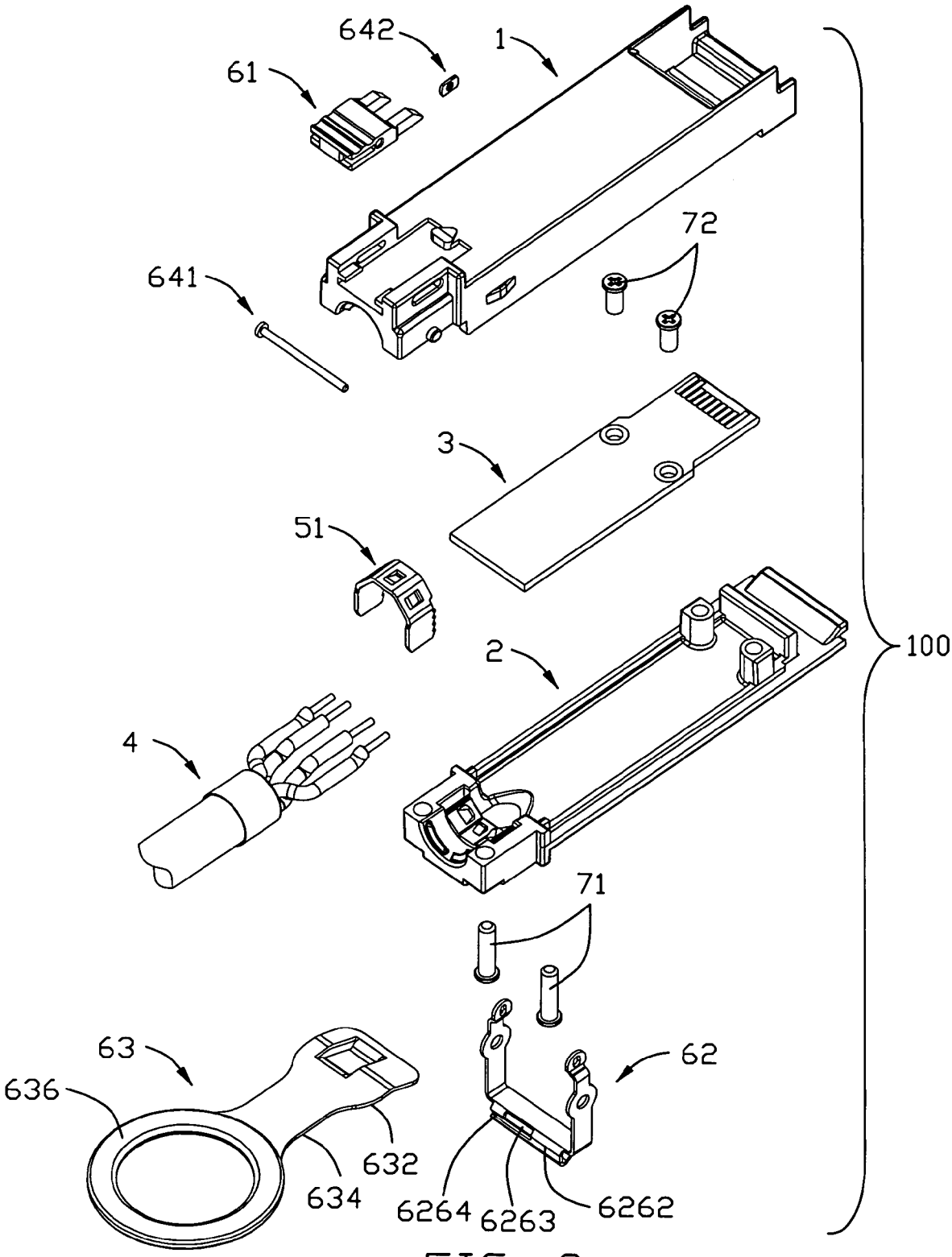
FIG. 3 is similar to FIG. 1, but viewed from other direction.
Figure 4:
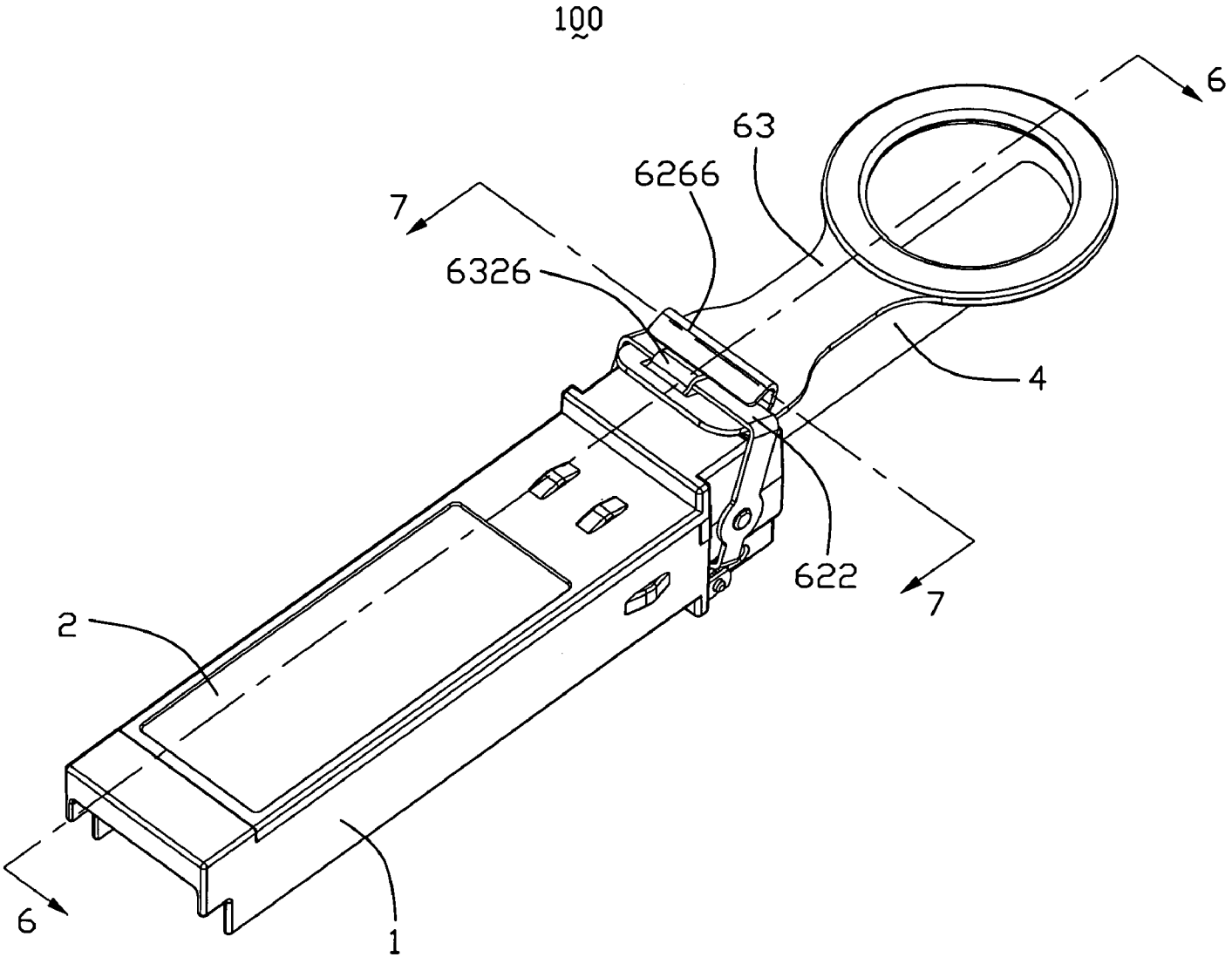
FIG. 4 is an assembled, perspective view of the cable connector.
Figure 5:
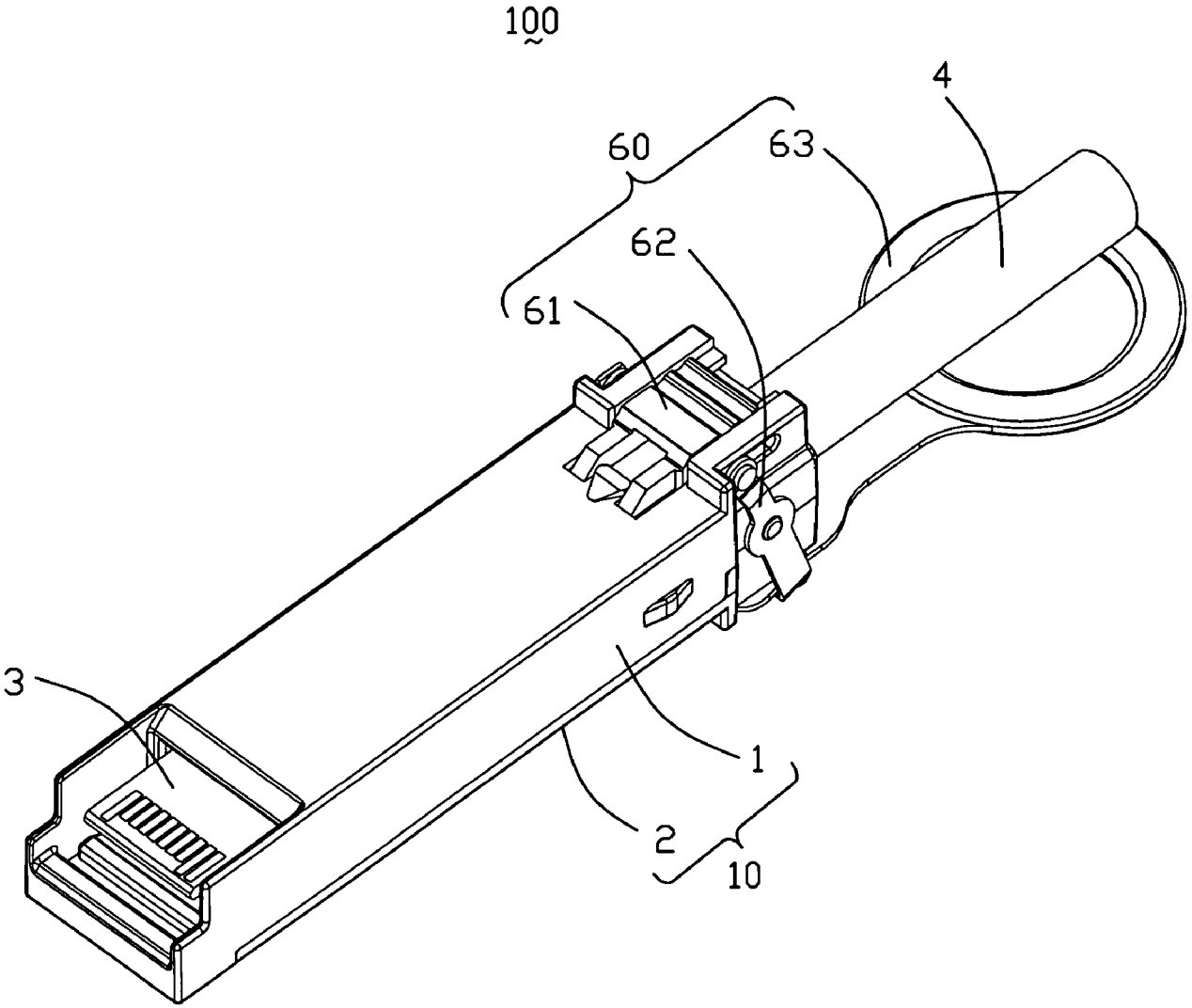
FIG. 5 is similar to FIG. 4, but viewed from other direction.
Figure 6:
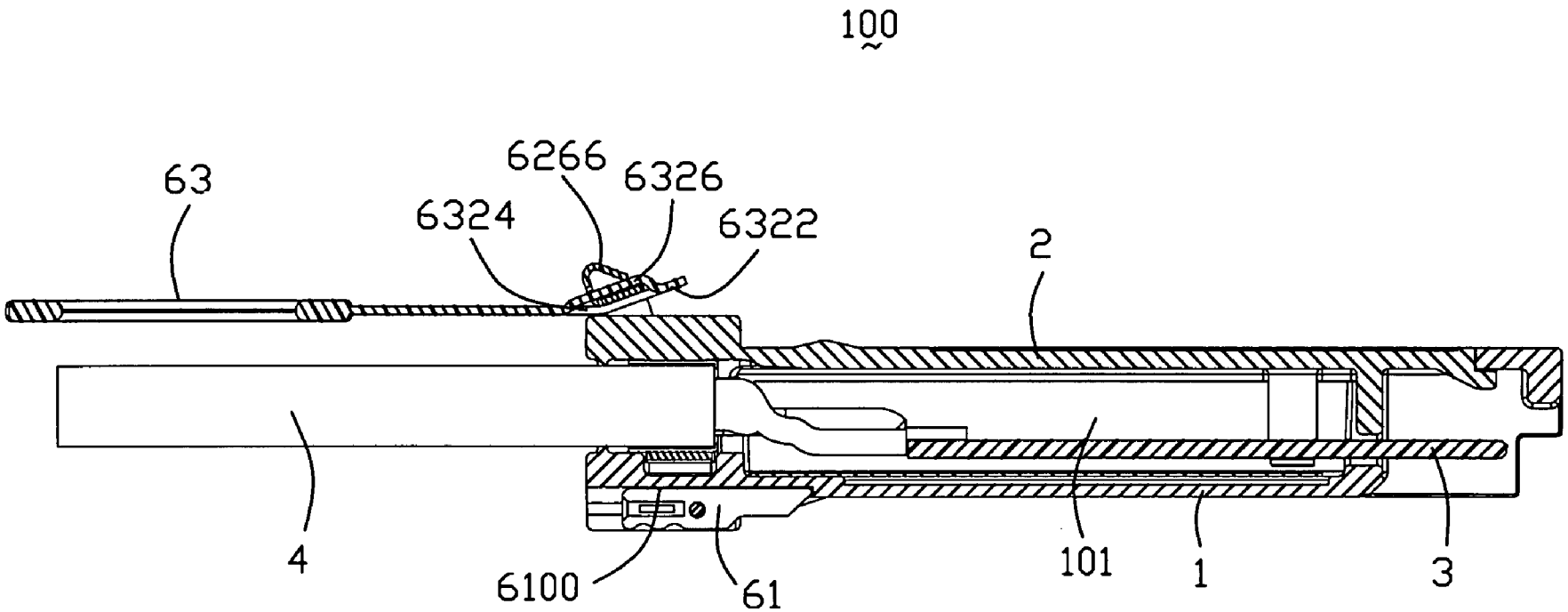
FIG. 6 is a cross-section view of FIG. 4 taken along line 6-6.
Figure 7:
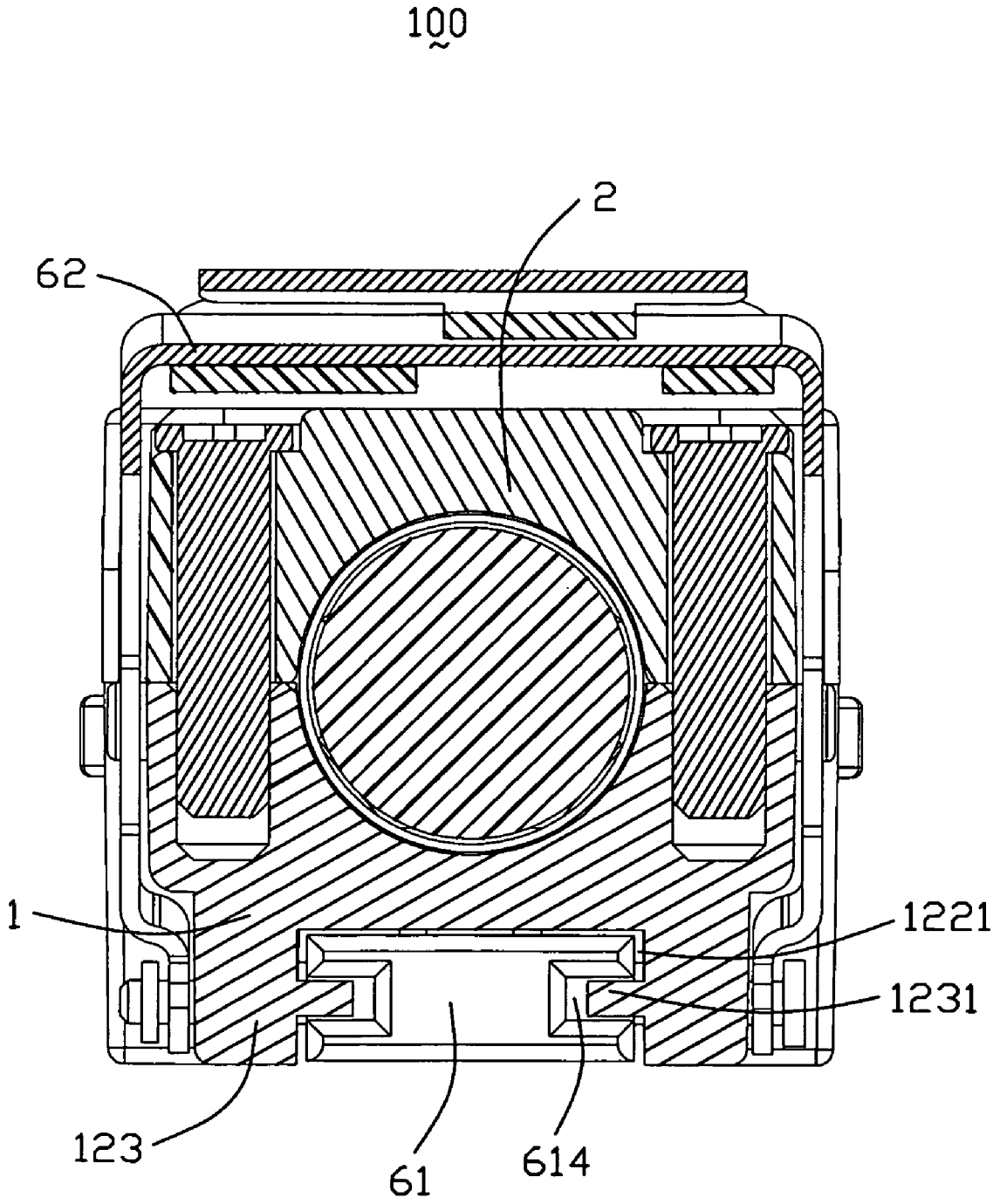
FIG. 7 is a cross-section view of FIG. 4 taken along line 7-7.

Referring to FIGS. 1-7, an electronic module 100 in accordance with the present invention comprises a housing 10 enclosing a hollow portion 101 therein, a printed circuit board (PCB) 3 accommodated in the hollow portion 10, a cable 4 coupled to rear section of the printed circuit board 3 and a latch mechanism 60 mounted to the housing 10.

The housing 10 includes a base portion 1 and a cover portion 2 and both of them are die-cast metal members or other metal plated pieces. Either the base portion 1 or the cover portion 2 includes an elongated front portion 11, 21 and a rear portion 12, 22 rearward extending from the front portion 11, 21, respectively.

The front segment 11 of the base portion 1 has a pair of upright lateral walls 111, 112 joining to lower a bottom wall 113 to corporately form the hollow portion 101 therebetween. A front section of the bottom wall 113 is cut to form a window 1131. A transversal beam portion 114 with substantially L-shaped cross-section interconnects distal portions of the pair of the lateral walls 111, 112.

The rear segment 12 of the base portion 1 has a pair of side walls 120, 121 and a lower wall 122 to corporately form a first semi-circular cavity 1201 and a deeper first position slot 1202 located in the front of the first semi-circular cavity 1201. A channel 1221 is recessed upward from a bottom surface of a middle area of the lower wall 122. A pair of guide members

123 are respectively arranged lateral sides along the channel 1221 and a locking tab 124 extending into the channel 1221 from a front edge thereof. A thin bar member 1231 is formed on an inward surface of a rear section of each guide member 123. A slider passage 1232 is defined in a front section of each guide member 123 and disposed in front of corresponding bar member 1231. Two cylinder members 1211 are respectively formed on upper sections of outward surfaces of the pair of side walls 120, 121. A pair of screw holes 1212 is respectively recessed downward from up surfaces of rear sections of side walls 120, 121.

The front segment 21 of the cover portion 2 has a planar portion 213 and a pair of flange portion 211, 212 formed on lateral sides of a bottom surface thereof. A pair of supporting posts 2131 are arranged on a front section of the planar portion 213 and extending downwardly from the bottom surface of thereof, and each supporting post 2131 further defines a screw hole 2132 therein. A protrusion portion 2134 is formed at forward end of the planar portion 213 and engages with A transversal beam portion 114 of the base portion 1.

The rear segment 22 of the cover portion 2 has a pair of side walls 220, 221 and a upper wall 222 to together form a second semi-circular cavity 2201 and a deeper second position slot 2202 located in the front of the first semi-circular cavity 2201. Two through holes 2221 are respectively defined in ends of the pair of side walls 220, 221.

The PCB 3 includes a circuit substrate 30 and two groups of conductive pads 31, 32 respectively disposed on a front and rear portions of the circuit substrate 30. A pair retaining holes 33 are arranged on a front portion of the circuit substrate 30. The cable 4 comprises a number of wires 41 and a jacket 40 enclosing thereon. The wires 41 of the cable 4 are soldered to the conductive pads 32 of the rear portion of the PCB 3. The PCB 3 is laid on the pair of supporting posts 2131 and the cable 4 exits outward the cover portion 2 through second semi-circular cavity 2201 therein. A pair of screws 72 are inserted into the pair of retaining holes 33 of the PCB 3 and assembled to the screw holes 2132 of the supporting posts 2131 to fix the PCB 3 to the cover portion 2. The cover portion 2 is assembled to the base portion 1, with the PCB 3 received in the hollow portion 101. Two screws 71 are inserted to the through holes 2221 of the cover portion 2 and assembled to the screw holes 1212 of the base portion 1 to combine them together. A pair of cable holders 51, 52 are received in the first and second position slots 1202, 2202 to grip the cable 4.

The latch mechanism 60 includes a slider member 61, a bail member 62 and a pull member 63.

The slider member 61 has a substantially rectangular shaped body portion 610 and two leg portions 612 extending forward from front face of the body portion 610. The two leg portions 612 are spaced from one another, with a passage 6120 formed therebetween, and each leg portion 612 further has a wedge-shaped front end. A pair of grooves 614 respectively are recessed inward from lateral surfaces of a rear segment of the body portion 610 and a transverse through hole 616 is defined in a middle section of the body portion 610 and adjacent to the grooves 614. The slider member 61 is mounted to the base portion 1, with the body portion 610 and two leg portions 612 accommodated in the channel 1221, the bar members 1231 of guide members 123 inserting into in the grooves 614 of the body portion 610 and the through hole 616 aligning with slider passages 1232 of guiding members 123. Thus, the slider member 61 is suspended above the base portion 1 of the housing 10. The term "suspended" herein depict a relative position that a bottom surface 6100 of the slider member 61 doesn't contact bottom surface of the channel 1221 or any top surface of an accessory or peripheral surface of the housing 10. By such arrangement, friction between the slider member 61 and the housing 10 may be reduced, and the slider member 61 moves along the housing 10 more freely.

The bail member 62 is configured to doorframe-shaped, including a doorhead 622 and two doorjambs 624. A curved handle member 626 is integrated with the doorhead 622. The handle member 626 includes a substantially vertical portion 6262 extending upwardly from a rear edge of the doorhead 622 and an inclined portion 6266 bent toward the doorhead 622. A cutout portion 6263 is defined in a lower segment of the vertical portion 6262 and adjacent to the rear edge of the doorhead 622. The cutout portion 6263 is offset to a left side of the handle member 626, rather than located in a middle section thereof, which may increase intensity of the handle member 626. While a slit portion 6264 is defined in an upper segment of the vertical portion 6262 and in communication to the cutout portion 6263. A positioning hole 6242 is defined in a middle section of each doorjamb 624, and a mounting hole 6246 is defined in a lower end of corresponding doorjamb 624.

The pull member 63 includes a header portion 632, a ring-shaped pull portion 636 and a connection portion 634 interconnecting the header portion 632 and pull portion 636. The header portion 632 has a turnup part 6322 extending forwardly and upwardly from a transversal deflection portion 6324 thereof, and an arched engaging part 6326 rising from a middle section of the header portion 632 and disposed above the deflection portion 6324. When assemble, the doorjamb 624 (may be left one) is inserted into a passage (not numbered) between the turnup part 6322 and the engaging part 6326, then the engaging part 6326 slides into the cutout portion 6263 via the slit portion 6264. Thus, the turnup portion 6322 and the engaging portion 6326 corporately hold the doorhead 622, with the handle member 626 abutting the deflection portion 6324 of the header portion 632. The inclined portion 6266 of the handle member 626 presses onto the engaging part 6326. The pull member 63 rearward extends beyond a back surface of the housing 10 and parallel with a bottom surface 6100 of the slider member 61. Such design may decrease friction between the slider member 61 and the channel 1221 and facilitate movement of the slider member 61.

The bail member 62 is pivoted linking with the base portion 1, with the cylinder members 1211 inserted into mounting hole 6246 of doorjamb 624. A bolt 641 is inserted through the positioning holes 6242 of the doorjamb 624, the slider passages 1232 of the guiding members 123 and through hole 616 of the slider member 61 to link them together, then a nut 641 is assembled to the bolt 641.

When the electronic module 100 is plugged into a cage of a receptacle module (not shown, referring to FIG. 13A of U.S. Pub. Pat. No. 2007/0117458A1), with locking tab 124 of the base portion 1 locking into corresponding hole of a spring member of the cage, therefore, the electronic module 100 combine with the receptacle module reliably. When the electronic module 100 unplugged from the receptacle module, a rearward force is exerted onto the pull members 63 to actuate the bail member 62 rotation around the cylinder members 1211, thus the slider member 61 moves forwardly, with the leg portions 612 thereof inserted into the cage to urge the spring member biasing outwardly to detach from the locking tab 124.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electronic module, comprising:

an elongated housing having a front portion and a rear portion, with a pair of spaced guide members integrated with a peripheral portion of the rear portion;

a latch mechanism assembled to the housing, said latch mechanism including a slider member disposed between and supported by the pair of guide members, a bail member pivotally engaging with the rear portion of the housing and further linking with the slider member to move the slider member; wherein a bar is formed on an inward surface of each guide member and inserted into a groove defined in corresponding lateral side of the slider member;

wherein a slider passage is defined in each guide member and proximate to the bar, wherein a through hole is defined in the slider and aligns with the slider passage;

wherein the bail member is configured to doorframe-shaped, including a doorhead connecting with two doorjambs;

wherein a positioning hole is defined in a middle section of each doorjamb, wherein a bolt is inserted through the positioning hole of the doorjamb, the through hole of the slider member and slider passage of the guide member; and wherein a mounting hole is defined in a lower portion of each doorjamb and linked to a cylinder member formed on a side wall of the rear portion of the housing.

2. The electronic module as recited in claim 1, wherein a bottom surface of the slider member does not contact the housing.

3. The electronic module as recited in claim 2, wherein a channel is defined in the rear portion of the housing and disposed between the pair of guide members.

4. The electronic module as recited in claim 3, wherein the slider member is suspended in the channel.

5. The electronic as recited in claim 1, wherein a handle member is formed on the doorhead of the bail member.

6. A cable connector assembly comprising:

a casing enclosing a mating port therein and opposite upper and lower faces thereon;

a slider intimately associated with the housing and linearly moveable relative thereto in a front-to-back direction;

a U-shaped bail member including a horizontal doorhead around said upper face and a pair of doorjambs at two opposite ends of said doorhead under a condition that the doorjambs are respectively pivotally mounted to two sides of the housing with a lower end of each of said doorjambs fixed to the slider around the lower face;

a unitary pull member defining a header portion, at a front portion, having a raised engaging part under a condition that a passage is formed between the engaging pail and a remainder portion of said header portion while both two opposite ends of the engaging part are unitarily formed with the remainder portion of the header portion; wherein the doorhead is received in said passage via one of said door jambs extending through said passage first, so that rearward pulling the pull member results in forward movement of the slider; wherein said bail member is further provided with a handle member having a portion cooperating with the door head to sandwich the engaging part therebetween; wherein said handle member is unitarily formed with the doorhead while with a slit portion to allow said engaging part to pass therethrough; and wherein said handle is further equipped with a cutout portion communicatively located beside the slit portion and dimensioned to comply with the engaging part so as to retain said engaging part therein.

* * * * *